US008113374B2

(12) United States Patent
Steiger et al.

(10) Patent No.: US 8,113,374 B2
(45) Date of Patent: Feb. 14, 2012

(54) CLOSURE FOR CONTAINER HAVING REMOVABLE PORTION AND SEALING MEMBRANE

(75) Inventors: John Steiger, Glenview, IL (US); Machelle D. Stockwell, Cary, IL (US)

(73) Assignee: Tropicana Products, Inc., Bradenton, FL (US)

( * ) Notice: Subject to any disclaimer, the term of this patent is extended or adjusted under 35 U.S.C. 154(b) by 578 days.

(21) Appl. No.: 11/842,699

(22) Filed: Aug. 21, 2007

(65) Prior Publication Data

US 2008/0078775 A1 Apr. 3, 2008

Related U.S. Application Data

(60) Provisional application No. 60/839,396, filed on Aug. 21, 2006.

(51) Int. Cl.
*B65D 51/22* (2006.01)

(52) U.S. Cl. ..... 220/258.4; 220/258.2; 220/258.5; 220/259.1; 220/359.2

(58) Field of Classification Search .... 220/258.1–259.1, 220/359.2, 361
See application file for complete search history.

(56) References Cited

U.S. PATENT DOCUMENTS 3,135,441 A * 6/1964 Wise et al. ..... 222/541.9
3,239,112 A * 3/1966 Porcelli ..... 222/541.9
3,278,089 A * 10/1966 Heekin et al. ..... 222/153.07
3,282,477 A * 11/1966 Henchert ..... 222/541.9
3,434,620 A * 3/1969 Laurizio ..... 220/258.2
3,458,080 A * 7/1969 Laurizio ..... 220/258.2
4,022,357 A * 5/1977 Dwinell ..... 222/537
4,359,169 A * 11/1982 Helms et al. ..... 220/255.1
4,568,005 A * 2/1986 Jalovec et al. ..... 222/472
4,682,702 A * 7/1987 Gach ..... 222/541.9
4,699,290 A * 10/1987 Adams ..... 220/258.2
4,815,618 A 3/1989 Gach (Continued)

FOREIGN PATENT DOCUMENTS

GB 2377701 1/2003

(Continued)

OTHER PUBLICATIONS

International Preliminary Report on Patentability, dated Mar. 5, 2009, PCT/US2007/076421.

(Continued)

*Primary Examiner* — J. Gregory Pickett
*Assistant Examiner* — Ned A Walker
(74) *Attorney, Agent, or Firm* — Banner & Witcoff, Ltd.

(57) ABSTRACT

A closure for a container includes a base having an aperture therethrough, a membrane attached to the bottom of the base and adapted to be attached to the container to seal the opening, a pull tab positioned within the aperture and connected to the base around at least a portion of an inner periphery of the aperture by a frangible portion, and a cap connected to the base by a hinge. The base is adapted to be connected to the container such that the aperture is positioned over the opening. The pull tab is connected to the membrane, so that when a user pulls on the pull tab, the frangible portion breaks to allow removal of the pull tab to open the aperture, and removal of the pull tab causes the portion of the membrane to tear away to unseal the opening of the container. The cap is pivotable about the hinge between an open position and a closed position.

9 Claims, 9 Drawing Sheets

U.S. PATENT DOCUMENTS

| | | | | |
|---|---|---|---|---|
| 4,901,892 | A | | 2/1990 | Song |
| 4,948,015 | A | * | 8/1990 | Kawajiri et al. ..... 222/107 |
| 5,054,641 | A | * | 10/1991 | Sato ..... 220/270 |
| 5,065,938 | A | * | 11/1991 | Anderson ..... 229/125.08 |
| 5,069,372 | A | * | 12/1991 | Kawajiri et al. ..... 222/541.9 |
| 5,101,999 | A | * | 4/1992 | Robichaud et al. ..... 220/258.4 |
| 5,108,029 | A | * | 4/1992 | Abrams et al. ..... 229/125.09 |
| 5,301,849 | A | * | 4/1994 | Guglielmini et al. ..... 222/517 |
| 5,320,889 | A | * | 6/1994 | Bettle, III ..... 428/36.6 |
| 5,499,736 | A | * | 3/1996 | Kohl ..... 220/254.5 |
| 5,735,426 | A | * | 4/1998 | Babcock et al. ..... 220/258.2 |
| 5,755,360 | A | * | 5/1998 | Elliott ..... 222/153.07 |
| 5,810,184 | A | * | 9/1998 | Adams et al. ..... 215/45 |
| 5,875,958 | A | * | 3/1999 | Weiteder et al. ..... 229/125.15 |
| D407,646 | S | * | 4/1999 | Mogard ..... D9/449 |
| 5,915,574 | A | * | 6/1999 | Adams et al. ..... 215/45 |
| 5,934,496 | A | * | 8/1999 | Mogard et al. ..... 220/258.3 |
| D414,698 | S | * | 10/1999 | Mogard et al. ..... D9/450 |
| 6,003,712 | A | * | 12/1999 | Mogard et al. ..... 220/259.5 |
| 6,016,931 | A | * | 1/2000 | Ohmi et al. ..... 215/256 |
| 6,079,618 | A | * | 6/2000 | Hedberg et al. ..... 229/125.15 |
| 6,129,228 | A | * | 10/2000 | Adams et al. ..... 215/45 |
| 6,158,197 | A | * | 12/2000 | Mogard et al. ..... 53/410 |
| 6,179,147 | B1 | * | 1/2001 | Mogard et al. ..... 220/258.2 |
| 6,185,906 | B1 | * | 2/2001 | Mogard et al. ..... 53/410 |
| 6,390,342 | B1 | * | 5/2002 | Mabee ..... 222/541.9 |
| 6,464,096 | B2 | * | 10/2002 | Adams et al. ..... 220/258.2 |
| 6,574,848 | B2 | * | 6/2003 | Fujie et al. ..... 29/281.5 |
| 6,877,630 | B2 | | 4/2005 | von Spreckelsen et al. |
| 6,883,689 | B2 | * | 4/2005 | Odet ..... 222/541.9 |
| 6,964,359 | B1 | | 11/2005 | Darr et al. |
| 7,413,097 | B1 | * | 8/2008 | Adams ..... 220/268 |
| D576,875 | S | * | 9/2008 | Steiger et al. ..... D9/449 |
| 7,578,040 | B2 | * | 8/2009 | von Spreckelsen et al. .... 29/469 |
| 7,721,901 | B1 | * | 5/2010 | Von Spreckelsen et al. .. 215/232 |
| 2005/0072816 | A1 | | 4/2005 | von Spreckelsen et al. |
| 2005/0092750 | A1 | * | 5/2005 | Lohrman et al. ..... 220/258.2 |
| 2005/0205618 | A1 | | 9/2005 | Mabee et al. |
| 2006/0289376 | A1 | | 12/2006 | von Spreckelsen et al. |
| 2007/0095835 | A1 | * | 5/2007 | Lohrman et al. ..... 220/258.2 |
| 2008/0179276 | A1 | * | 7/2008 | Lohrman et al. ..... 215/346 |
| 2008/0272084 | A1 | * | 11/2008 | Lohrman et al. ..... 215/255 |
| 2009/0277859 | A1 | * | 11/2009 | Von Spreckelsen et al. .. 215/232 |

FOREIGN PATENT DOCUMENTS

| | | | |
|---|---|---|---|
| WO | 9961337 | A2 | 12/1999 |
| WO | 0056612 | A | 9/2000 |

OTHER PUBLICATIONS

International Preliminary Report on Patentability, dated Mar. 5, 2009, PCT/US2007/076422.

International Search Report, dated Jan. 3, 2008, PCT/US2007/076421.

International Search Report, dated Jan. 17, 2008, PCT/US2007/076422.

* cited by examiner

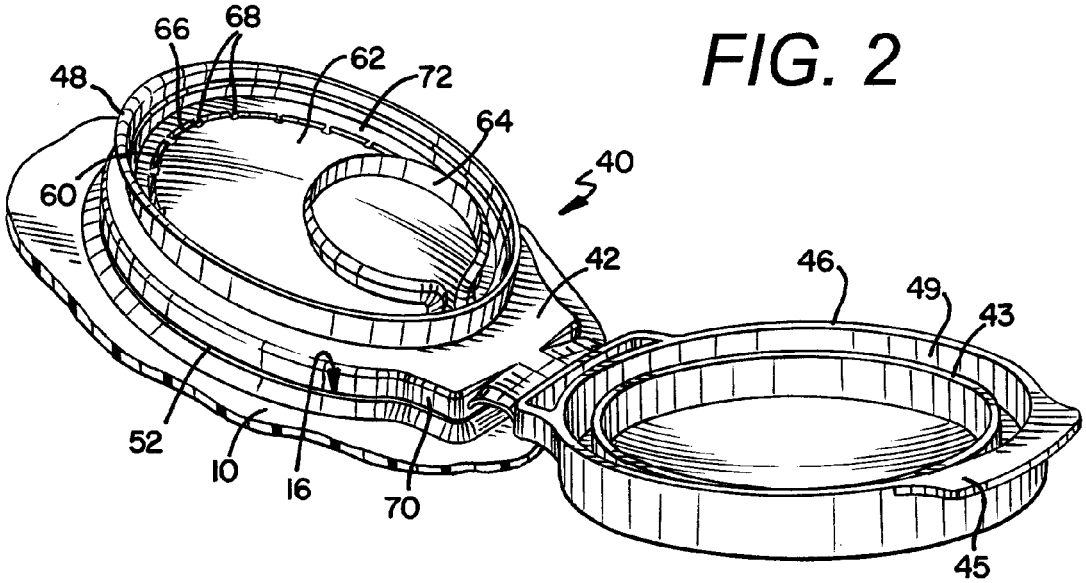
FIG. 2
FIG. 3
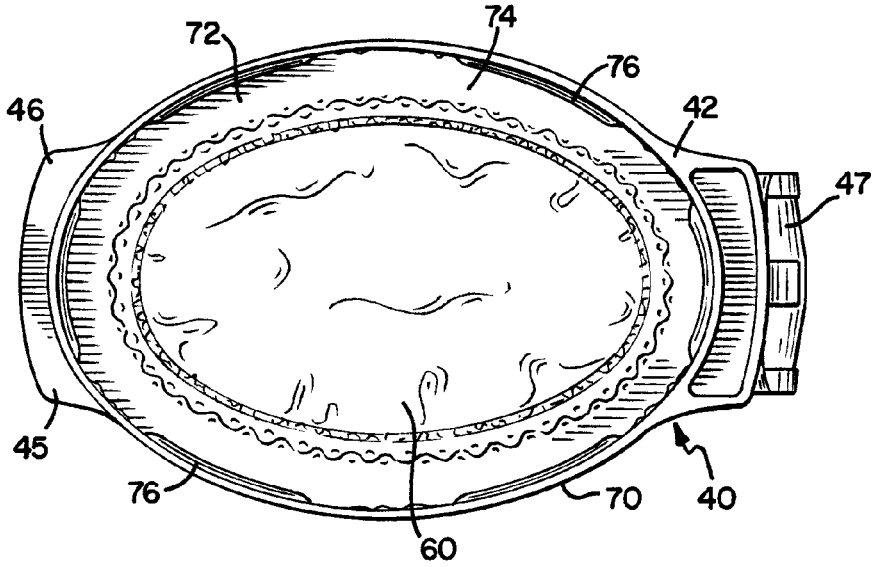

FIG. 10
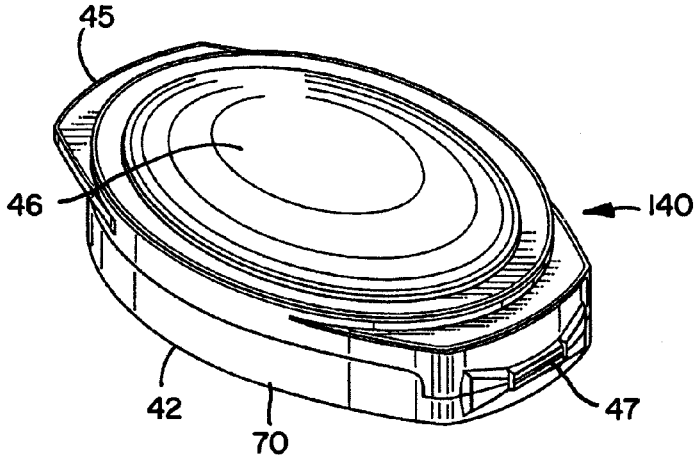
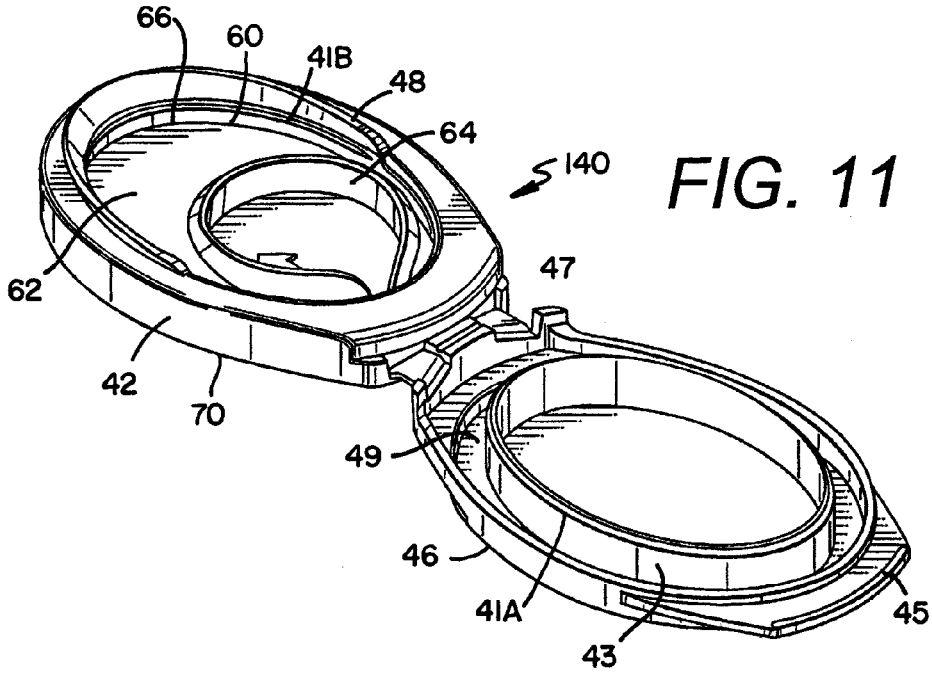
FIG. 11

Table I

CLOSURE FOR CONTAINER HAVING REMOVABLE PORTION AND SEALING MEMBRANE

CROSS-REFERENCE TO RELATED APPLICATIONS

The present application claims priority to and the benefit of U.S. Provisional Application No. 60/839,396, filed on Aug. 21, 2006, which application is incorporated herein by reference and made a part hereof.

TECHNICAL FIELD

The invention relates to a closure for a container for holding a flowable substance, and more specifically, to a closure having characteristics to enhance pouring and sealing of the container.

BACKGROUND OF THE INVENTION

It is known to make containers for liquid of plastics material, for example, high density polyethylene. Such containers may be hermetically closed by, for example, sealing the opening of the container with a membrane containing an aluminum or other foil. It is often difficult to remove such a membrane, and pieces of the membrane often remain in place on the neck after removal, which can be detrimental to resealing properties. Such membranes are also subject to flex cracking, which is produced by repeated flexing, such as may occur over long distance shipping.

The present assembly is provided to solve the problems discussed above and other problems, and to provide advantages and aspects not provided by prior closures of this type. A full discussion of the features and advantages of the present invention is deferred to the following detailed description, which proceeds with reference to the accompanying drawings.

SUMMARY OF THE INVENTION

Aspects of the present invention relate to a closure for a container. The closure includes a base having an aperture therethrough, a membrane attached to the bottom of the base and adapted to be attached to the container to seal the opening, a pull tab positioned within the aperture and connected to the base around at least a portion of an inner periphery of the aperture by a frangible portion, and a cap connected to the base by a hinge. The base is adapted to be connected to the container such that the aperture is positioned over the opening. The pull tab is connected to the membrane, so that when a user pulls on the pull tab, the frangible portion breaks to allow removal of the pull tab to open the aperture, and removal of the pull tab causes the portion of the membrane to tear away to unseal the opening of the container. The cap is pivotable about the hinge between an open position, where the flowable substance can flow through the opening, and a closed position, where the cap obstructs the opening to prevent the flowable substance from flowing through the opening.

According to one aspect of the invention, the base of the closure is adapted to be connected to the container body by a snap fit connection.

According to another aspect of the invention, the closure further includes a curved lip extending outward from the base around at least a portion of the aperture, and the lip is received in a complementarily shaped groove in the cap to form a pressure fit when the cap is in the closed position.

According to another aspect of the invention, the base has a plurality of saw teeth thereon, the saw teeth engaging the membrane to assist in tearing the membrane during removal of the pull tab.

According to another aspect of the invention, the pull tab has a pull ring therein, the pull ring adapted to be grasped by a user to exert force on the pull tab.

Other aspects of the invention relate to a closure for a container. The closure includes a base having an aperture therethrough, a membrane attached to the bottom of the base and adapted to be attached to the container to seal the opening, and a cap connected to the base by a hinge. The base is adapted to be connected to the container such that the aperture is positioned over the opening. The cap is pivotable about the hinge between an open position, where the flowable substance can flow through the opening, and a closed position, where the cap obstructs the opening to prevent the flowable substance from flowing through the opening. A portion of the base is removable from the base to define the aperture. The removable portion is attached to the membrane, such that removal of the removable portion from the base exerts a force on the membrane, tearing away a portion of the membrane to unseal the opening of the container.

According to one aspect of the invention, the removable portion of the base is a pull tab connected to the base by a frangible portion, such that the force exerted on the pull tab causes the frangible portion to break, permitting removal of the pull tab.

Further aspects of the invention relate to a container that includes a container body defining an internal cavity adapted to contain a flowable substance therein, a substantially elliptical opening in the container body adapted to allow the flowable substance to flow therethrough, a resealable closure affixed over the opening, and a membrane sealing the opening. The closure includes a hinged cap being moveable between an open position, where the flowable substance can flow through the opening, and a closed position, where the closure obstructs the opening to prevent the flowable substance from flowing through the opening. The membrane is connected to a removable portion of the closure, such that removal of the removable portion from the closure exerts a force on the membrane, tearing away a portion of the membrane to unseal the opening of the container.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 2 is a rear perspective view of the closure and container of FIG. 1, with the closure shown in an open position while sealed;

FIG. 3 is a bottom view of the closure of FIG. 1, with the closure shown in a closed position while sealed;

FIG. 10 is a rear perspective view of another embodiment of a closure, with the closure shown in a closed position;

FIG. 11 is a rear perspective view of the closure of FIG. 10, with the closure shown in an open position while sealed;

DETAILED DESCRIPTION

Figure 1:
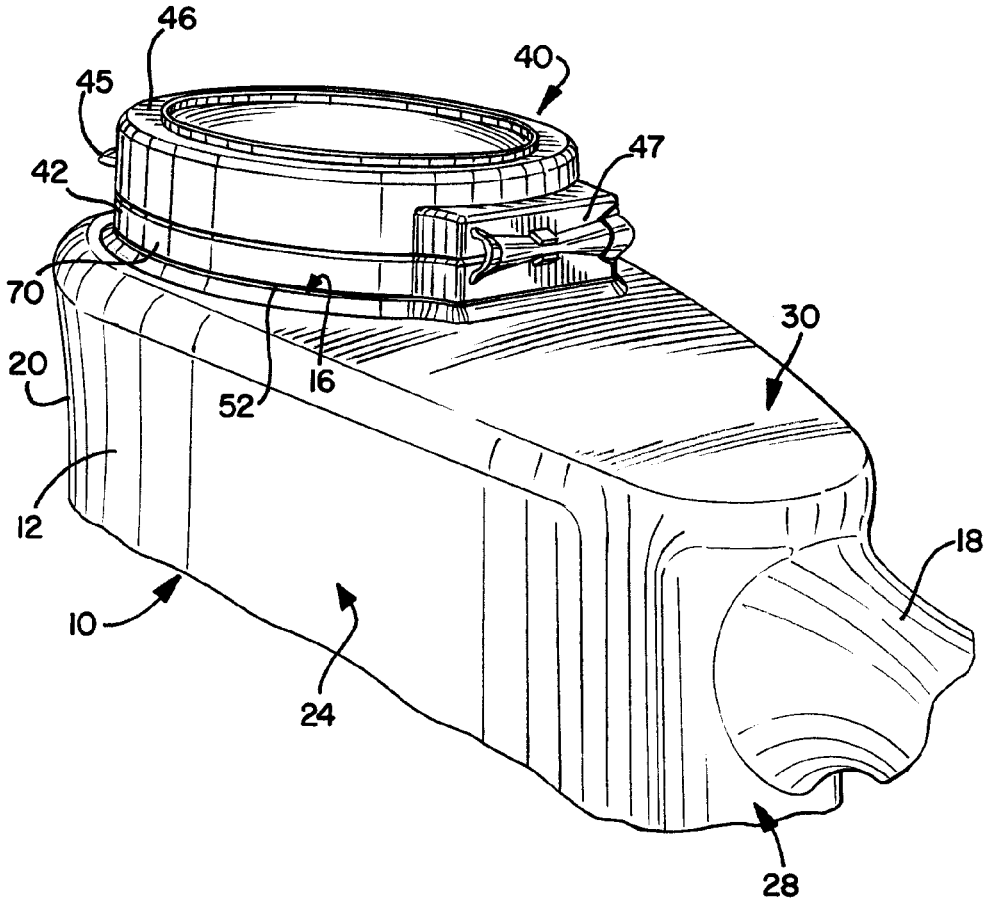
FIG. 1 is a rear perspective view of one embodiment of a closure connected to a container, with the closure shown in a closed position.
Figure 4:
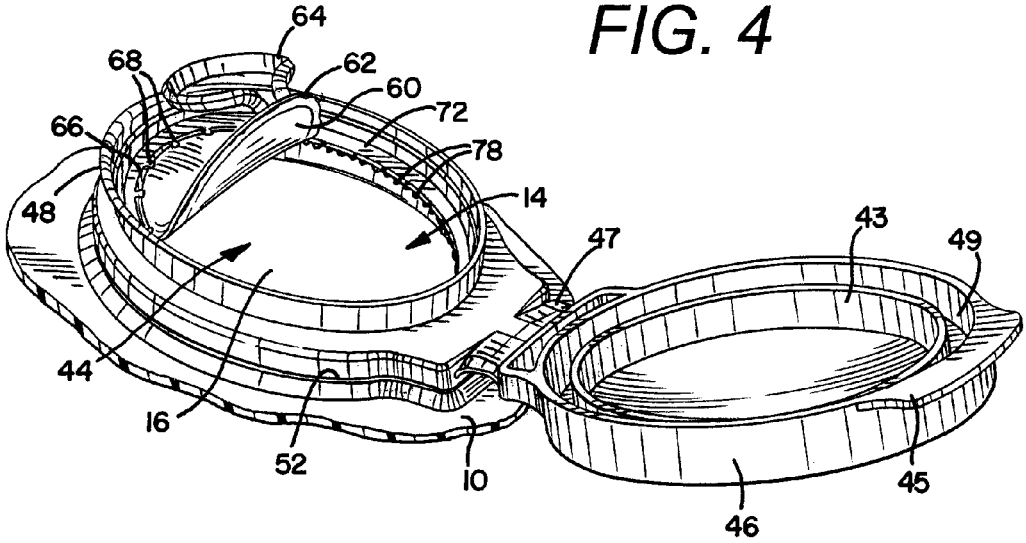
FIG. 4 is a rear perspective view of the closure and container of FIG. 1, with the closure shown in an open position while partially unsealed.
Figure 5:
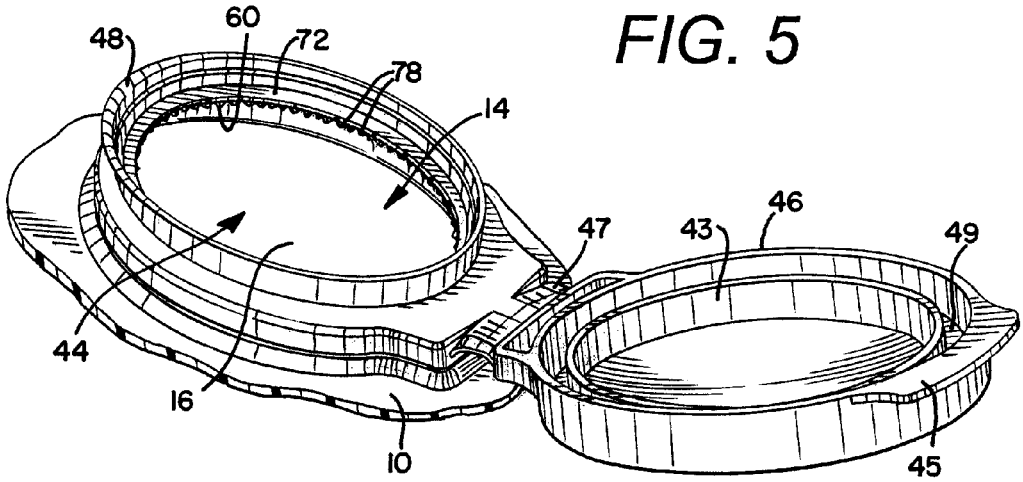
FIG. 5 is a rear perspective view of the closure and container of FIG. 1, with the closure shown in an open position while unsealed.

While this invention is susceptible of embodiments in many different forms, exemplary embodiments of the invention are shown in the drawings and will herein be described in detail with the understanding that the present disclosure is to be considered as an exemplification of the principles of the invention and is not intended to limit the broad aspect of the invention to the embodiments illustrated.

Referring initially to FIGS. 1-8, an exemplary embodiment of a closure 40 for a container is shown, mounted on a container 10 and positioned over an opening 16 of the container 10. The closure 40 generally includes a base 42 having an aperture 44 therethrough and a hinged cap 46 pivotably connected to the base 42 by a hinge 47. The closure 40 also includes a membrane 60 connectable to the container for sealing the opening 16 and a removable portion 62 connected to the membrane 60. Removal of the removable portion 62 from the closure 40 exerts a force on the membrane 60, causing the membrane to tear away or otherwise separate. The removable portion 62 in the closure 40 illustrated in FIGS. 1-8 is formed by a pull tab 62, as described below. In the embodiment of FIGS. 1-8, the closure 40 is elongated and non-circular, having a substantially elliptical shape.

Figure 9:
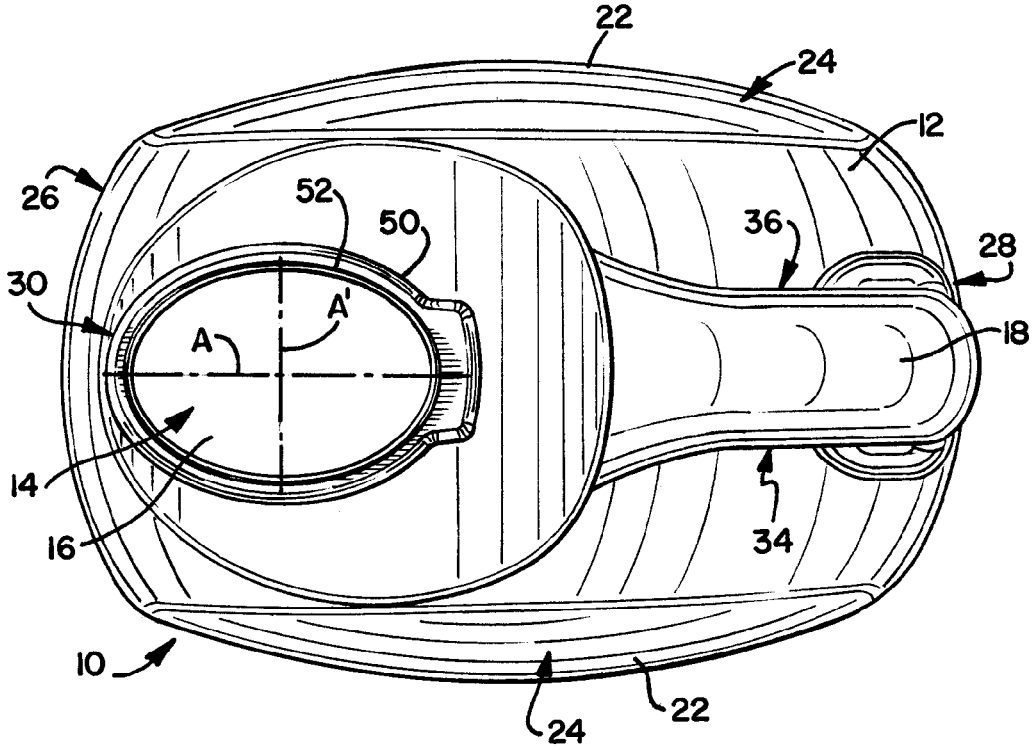
FIG. 9 is a full top view of the container of FIG. 1, shown without the closure.

FIG. 9 shows the entire container 10 of FIG. 1, which includes a container body 12 defining a cavity 14 therein, an opening 16, and a handle 18. The container 10 is adapted to contain a flowable substance therein, for example, a beverage or other liquid. The container body 12 has a top 30, a bottom 32, a front 26, a back 28, and opposed sides 24. The container body 12 further has a concave area 20 on the front 26 of the container 10 near the opening 16 and substantially flat panels 22 on opposed sides 24 of the container body 12. The opening 16 of the container 10 shown in FIG. 9 is an elongated and non-circular opening 16 that is substantially oval or elliptical in shape. As used herein, "elongated" means that the expanse of the opening is larger in one dimension (length or width) than in the other dimension. In the embodiment illustrated in FIG. 9, the opening 16 is oriented such that the longer dimension is oriented from the front 26 to the back 28 of the container 10, which is typically the direction the container 10 is oriented during pouring. The opening 16 is bounded by a rim 52 and a bead 50 extending around at least a portion of the periphery of the opening 16.

Figure 6:
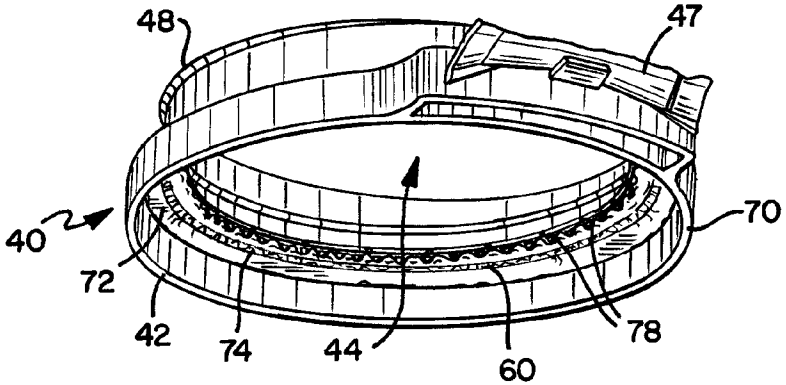
FIG. 6 is a partial bottom perspective view of the closure of FIG. 1, with the closure shown in an open position while unsealed.
Figure 7:
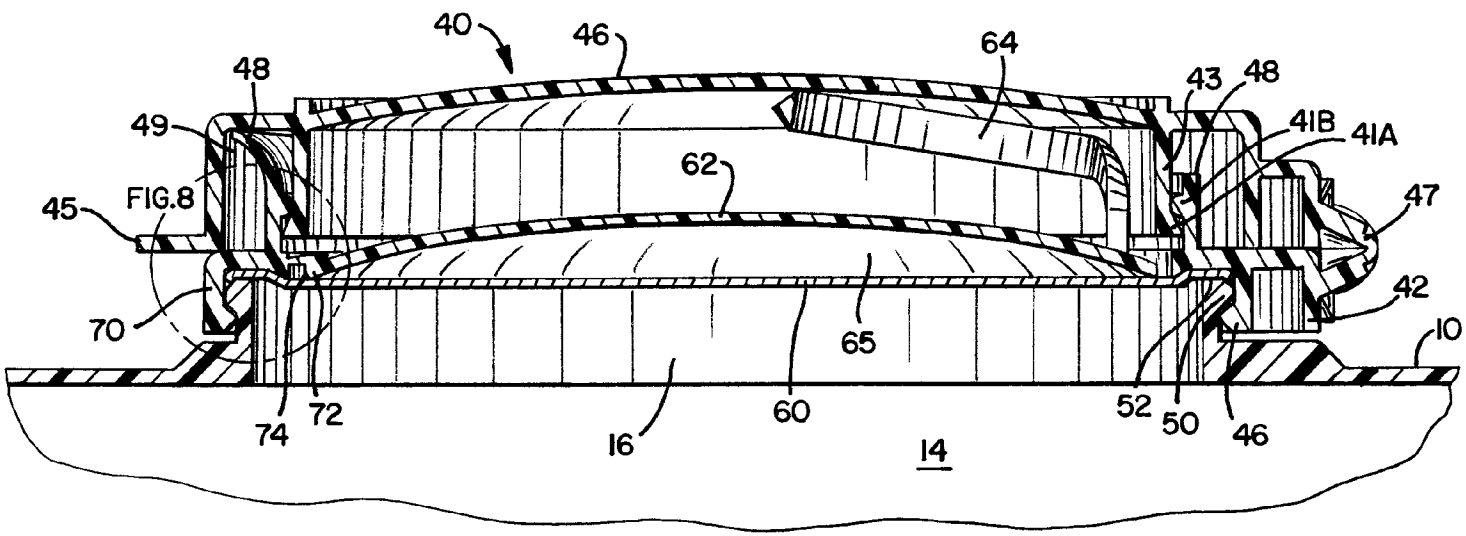
FIG. 7 is a cross section view of the closure and container of FIG. 1.
Figure 8:
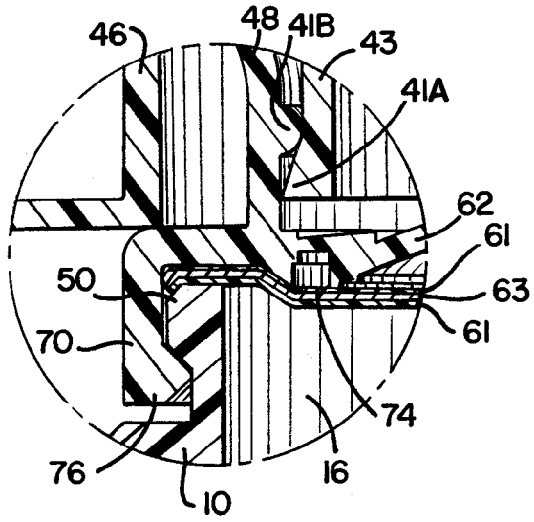
FIG. 8 is an enlarged cross section view of a portion of FIG. 7, showing a membrane and pull tab of the closure.

As illustrated in FIGS. 3, 6, and 7, the base 42 has a skirt 70 depending downward around the outer edge of the base 42. A flange 72 extends inwardly from the skirt 70, surrounding and defining the aperture 44. The underside of the flange 72 forms a ledge 74 that is recessed from the skirt 70. The ledge 74 has a plurality of saw teeth 78 located around the periphery of the aperture 44, which assist in removal of the membrane 60, as described below. A rib 76 extends around at least a portion of the inner surface of the skirt 70, and is adapted to interlock with the bead 50 surrounding the opening 16 of the container 10, as described below. In the embodiment shown in FIGS. 3 and 6, the rib 76 is formed by a plurality of intermittent protrusions around the inside of the skirt 70, but may be formed by a single protrusion in other embodiments. Additionally, in some exemplary embodiments, the base 42 has a curved lip 48 positioned around at least a portion of the aperture 44, and is curved in a manner so as to minimize dripping during and after pouring. The lip 48 of the closure 40 shown in FIGS. 2, 4, and 5 extends completely around the aperture 44. As described below, in other embodiments, the lip 48 may extend only a portion of the distance around the aperture 44.

The aperture 44 of the closure is defined within the base 42 and is surrounded by the flange 72. The aperture 44 is positioned in substantial alignment with the opening 16, and in certain exemplary embodiments, the aperture 44 is shaped similarly to the opening 16. In the closure 40 shown in FIGS. 1-8, the aperture 44 is an elongated and non-circular aperture 44 that is substantially oval or elliptical in shape. Fluid flowing through the opening 16 of the container will also flow through the aperture 44 in this configuration. In the embodiment illustrated in FIGS. 1, 2, 4, 5, and 9, the opening 16 and the aperture 44 are oriented such that the longer dimension is oriented from the front 26 to the back 28 of the container 10, which is typically the direction the container 10 is oriented during pouring. As illustrated in FIG. 9, the opening 16 is elongated along an axis of elongation A, which is also referred to as a major axis for an elliptical or substantially elliptical opening. The minor axis A' of the substantially elliptical opening 16 is also depicted in FIG. 9. Additionally, in the embodiment shown, the axis A is generally aligned with a centerline and an axis of symmetry of the container. In the embodiment shown in FIGS. 1, 2, 4, and 5, the aperture 44 is also positioned to be aligned and oriented so that the major axis of the aperture 44 is aligned with the major axis A of the opening 16. The handle 18 of the container is also generally aligned with the major axis A of the opening 16. This orientation and alignment encourages tipping of the container in the general direction of the major axis or axis of elongation, which can enhance pouring performance.

The hinged cap 46 is pivotable between a closed position (FIG. 1), where the cap 46 obstructs the opening 16 and the aperture 44, and an open position (FIGS. 2, 4 and 5), where the cap 46 does not obstruct the opening 16 and the aperture 44. The hinge 47 provides a flexible connection between the cap 46 and the base 42, allowing the cap to pivot with respect to the base in a hinged manner. In the embodiment shown in FIGS. 1-7, the hinge 47 is a single piece of flexible plastic material integrally connected to the cap 46 and the base 42. In other embodiments, a different type of hinge 47 may be used, such as a hinge employing a pivotable mechanical pin connection.

In the embodiment illustrated in FIG. 7, the cap 46 is secured in the closed position by a pressure fit between the cap 46 and the base 42, formed by the lip 48 being received in a complementarily-shaped groove 49 in the cap 46. The groove 49 is formed by a plug 43 that depends from the inner surface of the cap 46. The plug 43 engages the lip 48 to further strengthen the pressure fit, through engagement of opposing nubs 41A, 41B located on the plug 43 and the lip 48, respectively. The cap 46 also has a tab 45 located on the free end thereof, facilitating grasping or engaging the cap 46 by a user in order for the user to manipulate the cap 46 between the open and closed positions.

In the exemplary embodiment illustrated in FIGS. 1-8, the base 42, hinge 47, and cap 46 are integrally formed of a single piece. In this embodiment, the closure 40 may be formed of a single, integral piece by manufacturing the closure of a plastic material through injection molding. In other embodiments, other materials and forming techniques may be used.

The membrane 60 provides more secure sealing to the container 10. The membrane 60 is a polymer-coated foil that is connected to the rim 52 of the opening 16, and is also connected to the underside of the base 42 of the closure 40 around the edge of the aperture 44, such as by heat sealing or gluing. The membrane 60 shown in FIG. 8 has a thin layer of foil 63 coated by thin layers of plastic 61. In other embodiments, different types of known membranes 60 may be used. In one exemplary embodiment, the membrane 60 is first connected to the base 42 of the closure 40 by heat sealing around the edge of the membrane 60 to seal the membrane to the ledge 74 of the inner flange 72. In this configuration, the entire closure 40 can be transported, stored, and used in assembly as a single piece. The membrane 60 is also connected to the pull tab 62, such as by heat sealing, to facilitate removal of the membrane 60, as described below.

The pull tab 62 contains a pull ring 64 to assist in exerting force to effect removal of the pull tab 62. The pull tab 62 is positioned within the aperture 44 and is connected to the base 42 around the periphery of the aperture 44 by a frangible portion 66 formed from a plurality of bridges 68 extending between the pull tab 62 and the base 42. The pull tab 62 is removed by a user exerting force on the pull ring 64, which causes the frangible portion 66 to break away. In the embodiment shown in FIGS. 3, 7, and 8, the membrane 60 is connected to the pull tab 62 by heat sealing around the edges of the pull tab 62, forming a small pocket 65 between the membrane 60 and the pull tab 62. Accordingly, when the pull tab 62 is removed from the closure 40, force is exerted on the membrane 60, and a portion of the membrane 60 tears away to unseal the opening 16 of the container. The saw teeth 78 on the ledge 74 around the periphery of the aperture 44 engage the membrane 60 and the points of the saw teeth 78 assist in tearing the membrane 60.

The closure 40 may be connected to the container 10 by snapping the base 42 downward around the container opening 16. As shown in FIG. 7, as the closure 40 is pushed downward onto the opening 16 of the container 10, the rib 76 on the skirt 70 of the closure 40 snaps to interlock with the bead 50 on the rim 52 of the container opening 16. Once the closure 40 has been pressed into place, the rim 52 of the container 10 extends upward the skirt 70 surrounds the rim 52. In other embodiments, the closure 40 may be attached by other methods, such as gluing or spot welding, or may be formed integrally with the container 10. In further embodiments, the closure 40, or certain parts thereof, may be integrally formed with the container 10.

In one exemplary embodiment, the membrane 60 is connected to the closure base 42 prior to snapping the base 42 onto the container 10. In this embodiment, once the closure 40 is connected to the rim 52 of the container 10 in this manner, the membrane 60 can then be heat sealed to the rim 52 of the container 10, sealing the opening 10. When the closure 40 is connected to the container 10, the flange 72 and the pull tab 62 cover the entire top surface of the membrane 60, which can prevent damage to the membrane 60. In other embodiments, the membrane 60 may be attached in a different manner, such as using the membrane 60 to seal the opening 16 prior to snapping the closure 40 onto the container 10. It is understood that if the container 10 is to be filled with a flowable substance, such filling will typically be done prior to connecting the membrane 60 to the container 10. Once the closure 40 and membrane 60 are connected to the container 10, the opening 16 is sealed to prevent spilling of the container contents and to prevent ingress of contaminants into the container 10. As described above, in one exemplary embodiment, the pull tab 62 can be used to tear away a portion of the membrane 60 to unseal the opening 16, at which point the flowable substance can be poured from the container 10.

Figure 12:
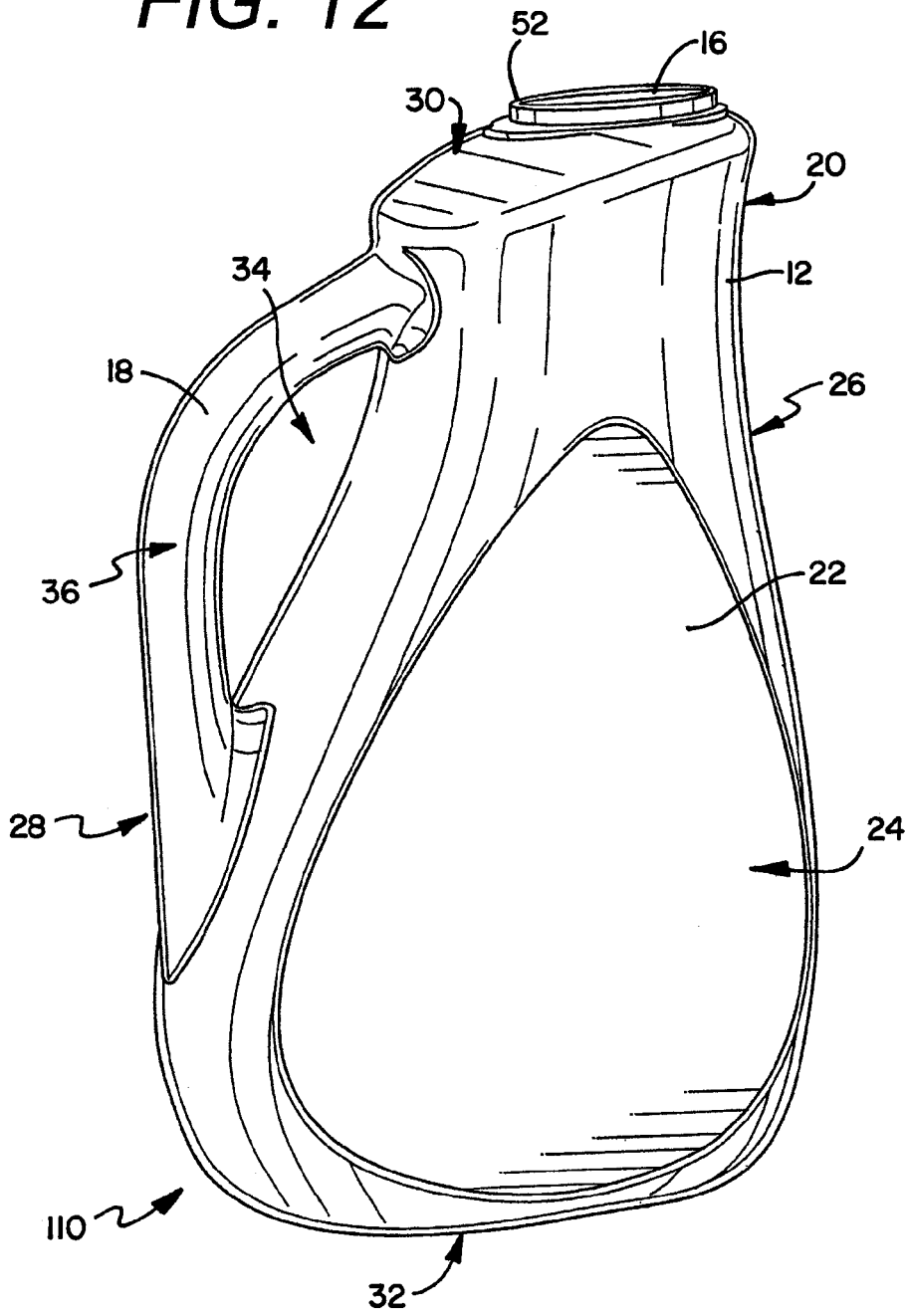
FIG. 12 is a rear perspective view of one embodiment of a container suitable for use with the closure of FIG. 10.
Figure 13:
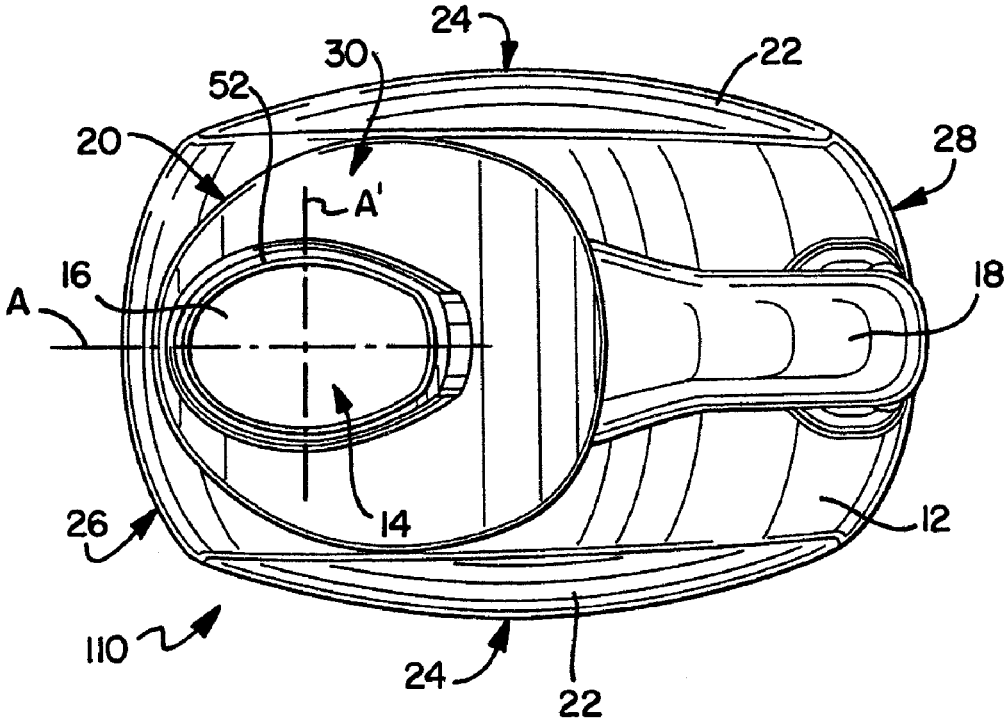
FIG. 13 is a top view of the container of FIG. 12.
Figure 14:
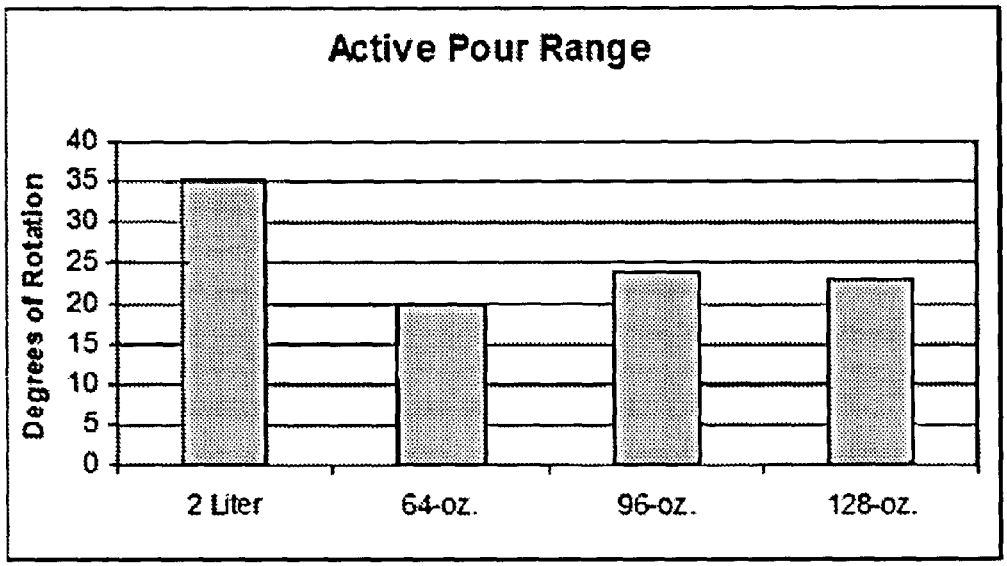

FIGS. 10-11 illustrate another embodiment of a closure 140 that is suitable for use with a container, such as the container 110 shown in FIGS. 12-13. As seen in FIGS. 12-13, the container 110 has an opening 16 and a rim 52 that are shaped differently than the container 10 of FIG. 9. The opening 16 of the container 110 of FIGS. 12-13 is elongated and non-circular, having a substantially elliptical shape, however the container 10 of FIG. 9 has an opening that is more exactly elliptical than the container 110 of FIGS. 12-13. The closure 140 of FIGS. 10-11 contains features similar to those described above with respect to the closure 40 of FIGS. 1-8, which are labeled with like reference numerals. One notable difference between the closures 40, 140 is that the lip 48 of the closure 140 of FIGS. 10-11 extends a portion of the distance around the periphery of the aperture 44, while the lip 48 of the closure 40 of FIGS. 1-8 extends around the entire periphery of the aperture 44. Additionally, the closure 140 of FIGS. 10-12 has a slightly different external shape and contour, to cooperate with the differently shaped opening 16 of the container 110 of FIGS. 12-13. Generally, other features of the closures 40, 140 and containers 10, 110 illustrated are similar.

The features of the exemplary embodiments of the closures 40, 140 described herein provide for improved sealing and increased ease of unsealing the container 10, 110. The use of the pull tab 62 facilitates tearing of the membrane 60 to open the container 10, 110, which can be difficult in many prior containers. The flip cap 46 in the closures 40, 140 provides for quick and easy opening and closing of the container 10, 110, as well as secure resealing for storage purposes. Additionally, the flip cap design can be easily modified to fit an elongated, non-circular, and/or substantially elliptical opening 16 in the container, which works to provide improved pouring. Further, the cap 46 is effectively tethered to the container 10, 110 in the flip cap design, which prevents the cap from being dropped or lost.

The features of the exemplary embodiments of the containers 10, 110 and closures 40, 140 herein provide for improved rate and control of pouring of the flowable substance from the container 10, 110. The narrowed front 70 of the opening 16 and the aperture 44 provide for a slow initial pour, increasing control of pouring and decreasing spilling and splashing, particularly when the container 10 is tipped along the axis A during pouring. The elongated nature and orientation of the opening 16 permits increased airflow back through the rear 72 of the opening 16 and aperture 44 during pouring without obstructing or interrupting such airflow, increasing maximum flow rate and reducing glugging during pouring. Reduced glugging also results in increased pouring control and reduced spilling and splashing.

Table I illustrates the improved pouring provided by the containers 10, 110 and closures 40, 140 described above. A container similar to the container 10 of FIGS. 1 and 9, having a closure similar to the closure 40 of FIGS. 1-8, was substantially filled with a liquid. The container was tilted over a range of tilt angles to effect pouring of the liquid contents. The range of tilt angles was measured over which no glugging or interruption of airflow into the container was observed. These tilt angles were measured as the difference between the angle where the flowable substance began to flow through the opening and the angle where the flowable substance began glugging, resulting from interruption of airflow into the container. The same process was followed with an existing 64-oz paperboard carton with a circular opening and existing 96-oz and 128-oz plastic containers having circular openings. The measured results are illustrated in Table I below.

As illustrated by Table I, the container 10 and closure 40 exhibited smooth pouring with no observable interruption of airflow into the container over a range of tilt angles of up to approximately 35 degrees from the initial pour. No other container tested exhibited such performance over a range of tilt angles of approximately 25 degrees or more. The container 10 having the substantially elliptical opening 16 and the closure 40 with the substantially elliptical aperture 44 exhibited an increase in pouring range of approximately 50% or more, compared to other containers tested, having circular openings. It is understood that different containers may exhibit different flow rates and pouring angles when the container is less than substantially full.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "length," "width," etc., as used herein, are intended for illustrative purposes only and do not limit the embodiments in any way. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A closure for a container containing a flowable substance, the container having an opening therein for passage of the flowable substance therethrough, the closure comprising:

a base adapted to be connected to the container around the opening, the base comprising a skirt, a flange extending inward from the skirt, the flange including a plurality of saw teeth, and a pull tab, the pull tab comprising a center portion, a periphery, and a pull ring, the periphery of the pull tab connected to the flange by a frangible portion, wherein when a user pulls on the pull ring, the frangible portion breaks to allow removal of the center portion of the pull tab to open an aperture through the base;

a membrane attached to the bottom of the flange and adapted to be attached to the container to seal the opening, the periphery of the pull tab being further connected to a peripheral portion of the membrane such that the center portion of the pull tab is spaced from a central portion of the membrane to create a pocket between the central portion of the membrane and the center portion of the pull tab, and wherein removal of the pull tab causes the membrane to engage the plurality of saw teeth, assisting in tearing away the central portion of the membrane to unseal the opening of the container; and a cap connected to the base by a hinge, the cap being pivotable about the hinge between an open position, wherein the flowable substance can flow through the opening, and a closed position, wherein the cap obstructs the opening to prevent the flowable substance from flowing through the opening.

2. The closure of claim 1, wherein the base of the closure is adapted to be connected to the container body by a snap fit connection.

3. The closure of claim 1, wherein the center portion of the pull tab has an arched configuration to create the pocket between the membrane and the pull tab.

4. The closure of claim 1, further comprising a curved lip extending outward from the flange of the base around at least a portion of the periphery of the pull tab.

5. The closure of claim 4, wherein the lip is received in a complementarily shaped groove in the cap to form a pressure fit when the cap is in the closed position.

6. A closure for a container containing a flowable substance, the container having a substantially elliptical opening therein for passage of the flowable substance therethrough, the closure comprising:

a substantially elliptical base adapted to be connected to the container around the opening, the base comprising a substantially elliptical skirt, a substantially elliptical flange extending inward from the skirt, the flange including a plurality of saw teeth, and a substantially elliptical pull tab, the pull tab comprising a center portion, a periphery, and a pull ring, the periphery of the pull tab connected to the flange by a frangible portion, wherein when a user pulls on the pull ring, the frangible portion breaks to allow removal of the central portion of the pull tab to open a substantially elliptical aperture through the base;

a membrane attached to the bottom of the flange and adapted to be attached to the container to seal the opening, the periphery of the pull tab being further connected to a peripheral portion of the membrane such that the center portion of the pull tab is spaced from a central portion of the membrane to create a pocket between the central portion of the membrane and the center portion of the pull tab, and wherein removal of the pull tab causes the membrane to engage the plurality of saw teeth, assisting in tearing away the central portion of the membrane to unseal the opening of the container; and a substantially elliptical cap connected to the base by a hinge, the cap being pivotable about the hinge between an open position, wherein the flowable substance can flow through the opening, and a closed position, wherein the cap obstructs the opening to prevent the flowable substance from flowing through the opening, wherein the substantially elliptical base, the substantially elliptical skirt, the substantially elliptical flange, the substantially elliptical aperture, and the substantially elliptical cap are elongated along a first axis, such that the base, the skirt, the flange, the aperture, and the cap all have a longer dimension along the first axis as compared to a second axis perpendicular to the first axis.

7. The closure of claim 6, wherein the center portion of the pull tab has an arched configuration to create the pocket between the membrane and the pull tab.

8. The closure of claim 6, further comprising a curved lip extending outward from the base around at least a portion of a periphery of the aperture.

9. The closure of claim 8, wherein the lip is received in a complementarily shaped groove in the cap to form a pressure fit when the cap is in the closed position.

* * * * *